United States Patent [19]

Fielding

[11] Patent Number: 4,634,192

[45] Date of Patent: Jan. 6, 1987

[54] ROLLER TOWEL APPARATUS

[75] Inventor: Robert M. G. Fielding, Annes, England

[73] Assignee: Dudley Industries Limited, Lytham, England

[21] Appl. No.: 758,509

[22] Filed: Jul. 24, 1985

[30] Foreign Application Priority Data

Jul. 24, 1984 [GB] United Kingdom ..... 8418832

[51] Int. Cl.[4] ..... B65H 19/00

[52] U.S. Cl. ..... 312/37; 242/55.3

[58] Field of Search ..... 312/37, 40, 38, 41, 312/39; 221/27; 242/55.3, 55.53

[56] References Cited

U.S. PATENT DOCUMENTS 3,698,653 10/1972 Okamura ..... 312/37 X
4,222,621 9/1980 Greenlee et al. ..... 312/37
4,422,585 12/1983 Schultz ..... 312/37 X
4,552,315 11/1985 Granger ..... 312/39 X

FOREIGN PATENT DOCUMENTS 1778115 8/1971 Fed. Rep. of Germany ..... 312/37
774970 5/1957 United Kingdom ..... 312/37

*Primary Examiner*—James T. McCall
*Attorney, Agent, or Firm*—Connolly & Hutz

[57] ABSTRACT

A roller towel dispenser has two roller towels mounted side-by-side, each of which is automatically brought into operation upon exhaustion of the other. As the end of a towel passes between two combs, a towel reservoir is biassed to pivot upwards which operates a link which, at the other side of the dispenser cabinet, pivots a container plate to cause a take-up roller to move towards a further roller. Simultaneously, a corresponding shield is operated by a further link to release a loop of the new towel for use.

10 Claims, 5 Drawing Figures

ROLLER TOWEL APPARATUS

BACKGROUND OF THE INVENTION

The present invention relates to apparatus for dispensing roller towels.

Roller towel cabinets are inspected periodically to check if the towel has been used up and needs replacing. Inevitably there is a delay between the exhaustion of the towel and the next inspection. This has the disadvantage that the cabinet is out of action for a period.

The present invention seeks to overcome or reduce the above disadvantage.

One solution to this problem is proposed in GB Patent No. 774,970. The dispensing device disclosed in that document comprises a first unit with a primary towel arranged above a second unit with a secondary towel, the secondary towel being released for use after the primary towel has become exhausted. When replacing the primary towel with a fresh towel, the attendant either:

(i) also replaces the secondary towel, which results in part of the discarded secondary towel remaining unused; or (ii) draws up the loop of the secondary towel without replacing it; this is a time-consuming operation and leads to a reduced reserve of secondary towel after the primary towel again becomes exhausted.

When the secondary towel is not in use, it is concealed to a limited extent by the primary towel.

SUMMARY OF THE INVENTION

The present invention seeks to provide an improved multiple roller towel dispensing device.

A first aspect of the present invention provides a roller towel dispenser arrangement comprising first and second means for mounting respective roller towels, first detecting means for detecting when a roller towel mounted in said first mounting means is exhausted, first control means responsive to said first detecting means for allowing dispensing of a roller towel mounted in said second mounting means, second detecting means for detecting when said second roller towel is exhausted, and second control means responsive to said second detecting means for allowing dispensing of a roller towel mounted in said first mounting means.

A second aspect of the present invention provides a roller towel dispenser arrangement comprising first and second means for mounting respective roller towels, detecting means for detecting when a roller towel on said first mounting means is exhausted, and an element for holding and concealing a roller towel on said second mounting means, wherein said element is actuable by said detecting means to automatically release said towel.

BRIEF DESCRIPTION OF THE DRAWINGS

A preferred embodiment of the present invention will now be described, by way of example only, with reference to the accompanying drawings, of which.

DESCRIPTION OF THE PREFERRED EMBODIMENTS

Figure 5:
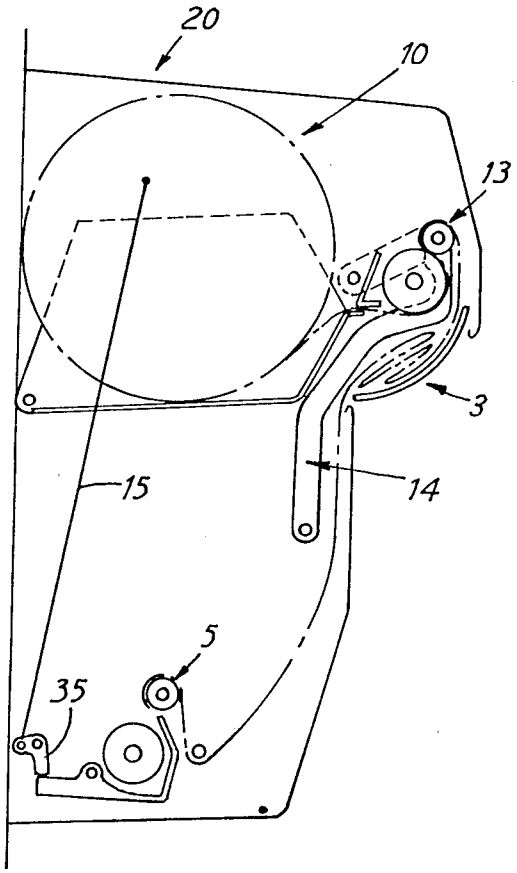
FIGS. 2 to 5 are schematic side sectional views of the cabinet of FIG. 1 showing respective stages of its operation.
Figure 1:
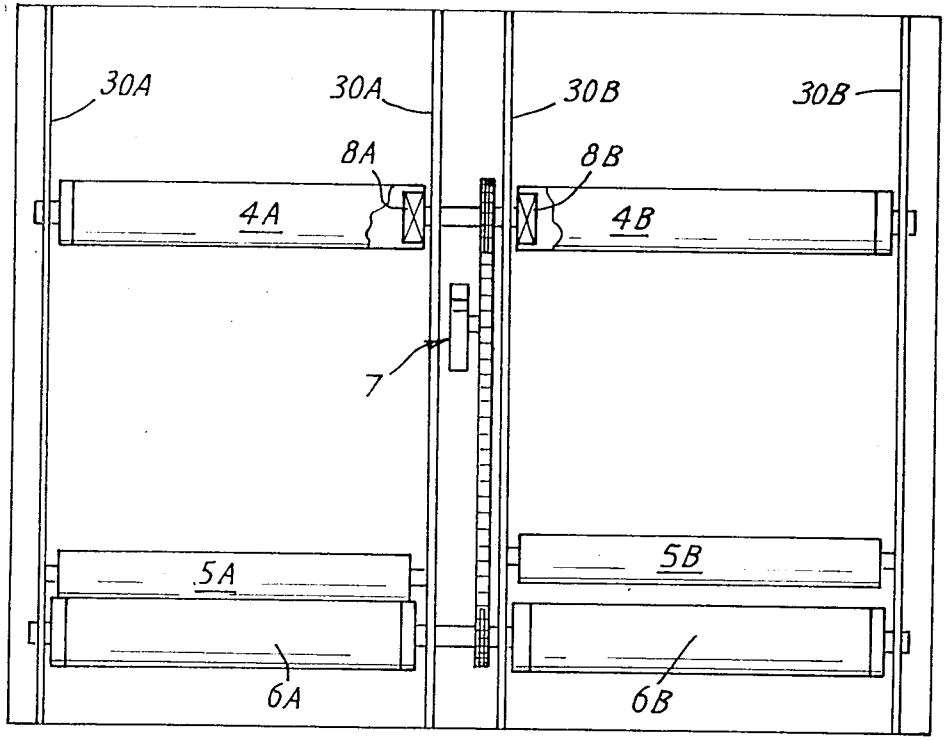
FIG. 1 is a schematic front sectional view of a roller towel cabinet in accordance with the present invention.

Basically, according to a first aspect of the present invention there is provided a roller towel dispenser arrangement comprising first and second means for mounting respective roller towels, first detecting means for detecting when a roller towel on the first mounting means is exhausted, first control means responsive to said first detecting means for allowing dispensing of a roller towel on the second mounting means, second detecting means for detecting when the second roller towel is exhausted, and second control means responsive to said second detecting means for allowing dispensing of a roller towel on the first mounting means.

In a preferred arrangement a drive mechanism for each roller towel includes a driven roller and a take-up roller through which the towel is arranged to pass, the control means keeping said rollers apart when the towel is not in use and causing the rollers to move together to allow dispensing of the towel. Preferably each mounting means is associated with a towel holding and concealing element which is actuated by the control means to automatically release the towel for use. In a preferred arrangement each mounting means has at least one access door in the cabinet, the door having a plate projecting internally therefrom, and the associated towel holding and concealing element has three positions, in the first of which it holds and conceals a towel, in the second of which (with the door closed) it releases a towel for use and engages a side face of the plate, and in the third of which (with the door open) it is in the path of the plate, whereby the door cannot be closed until the element is moved out of its third position.

Each mounting means may comprise a pivotally-mounted reservoir and each detecting means may comprise a link member; upon exhaustion of a towel contained in a reservoir, the reservoir pivots to actuate the respective link member. Preferably each control means comprises a pivotal member, actuated directly or indirectly by its respective link member, and pivoting of the pivotal member causes the rollers to move together to allow dispensing of the towel. The pivoting of the pivotal member may also actuate a further link member which actuates said towel holding and concealing element for automatic towel release.

In a preferred arrangement each mounting means includes a re-setting link member, whereby, upon a downward pivotal movement of the mounting means during insertion of a new towel, said re-setting link member re-sets the respective control means. The re-setting link member is attached to the underside of the reservoir and actuates the pivotal member to cause the rollers to move apart.

In accordance with a second aspect of the present invention there is provided a roller towel dispenser arrangement comprising first and second means for mounting respective roller towels, detecting means for detecting when a roller towel on the first mounting means is exhausted, and an element for holding and concealing a roller towel on the second mounting means, wherein the element is actuable by the detecting means to automatically release the towel.

Figure 3:
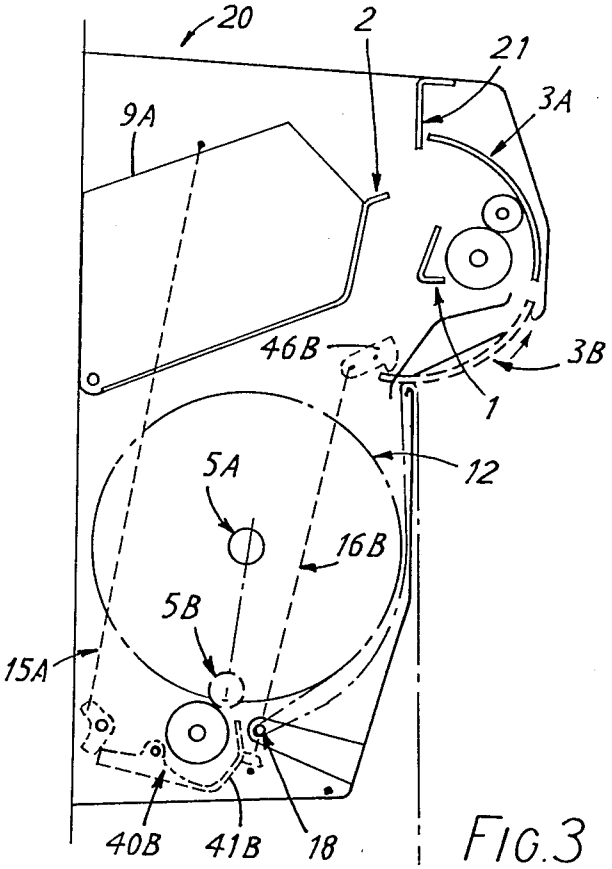

Referring to the drawings, the cabinet 20 holds two centre-less wound roller towels 10 each of 50 meter length mounted side-by-side. The operating mechanisms for the two towels are substantially identical and the two sides, referred to as side A and side B, operate substantially symmetrically. Each towel 10 passes through a respective arrangement of combs 1,2. Comb 1 is fixed between the side plates 30 of the mechanism. Comb 2 is formed by the front edge of a pivoting clean towel reservoir 9 which is biassed in an anticlockwise direction by a spring (not shown). When towel is not present reservoir 9 pivots from the position shown in FIG. 2 to that shown in FIG. 3, the teeth of comb 2 passing between the teeth of comb 1.

The towel 10 then passes around a driver roller 4 the surface of which is covered with some medium which grips the towel without slippage. The towel then passes between drive roller 4 and a pinch roller 13 which is pivotally mounted on two arms 14 (see FIG. 4) and is retained in position by the spindle entering slots 33 on the side plates 30.

Loop 11 is the length of usable towel which emerges from behind a pivoting shield 3. Towel 10 then passes under a guide bar 18 mounted on arms 38 attached to a bottom door 19 of the cabinet, and round its respective take-up roller 5 which is rotated by a roller 6, itself driven in a one-to-one ratio by the respective drive roller 4. Numeral 12 indicates the position of the fully taken-up towel.

The flow of towel, when pulled by a user, is interrupted by an escapement device 7 connected to the drive train between rollers 4 and 6. The drive may be transmitted by chain, belt, shafts or gears and is common to both mechanisms A and B, being driven by either roller 4A or 4B through clutch mechanisms 8A and 8B. Thus rotation of either roller 4A or 4B will cause an equal rotation of both rollers 6A and 6B.

In use one of the towels is accessible for use although both are prepared for use. Initially the exposed towel is used as in common towel cabinet application i.e. pulling of a length of towel from the machine causes rotation of drive roller 4. Roller 6 is driven from a roller 4 in a one to one ratio so that towel is wound onto movable take up roller 5 in equal length to that pulled out over roller 4.

If side A is in operation, the towel in side B is held out of sight behind movable flap 3B and take up roller 5B is held out of contact with roller 6B. Thus towel in side B does not move.

On exhaustion of the towel at side A, the towel end is detected by movement of the 'comb' arrangement 1, 2. This movement causes activation of a mechanism described below which exposes the reserve towel at side B and allows the take up roller 5B to drop into contact with its driving roller 6B thus completing presentation of the towel for use.

The mechanism for effecting changeover from dispensing of one towel to dispensing of the other towel will now be described. It comprises two links 15A and 15B. The top of link 15A is engaged and moved upwards by the side edge of reservoir 9A in its FIG. 3 position. The lower end of link 15A is attached to a two-arm lever 35B associated with the other side of the double towel mechanism. A substantially symmetrical arrangement is provided whereby a link 15B actuated by reservoir 9B is attached to a two-arm lever 35A.

Figure 4:
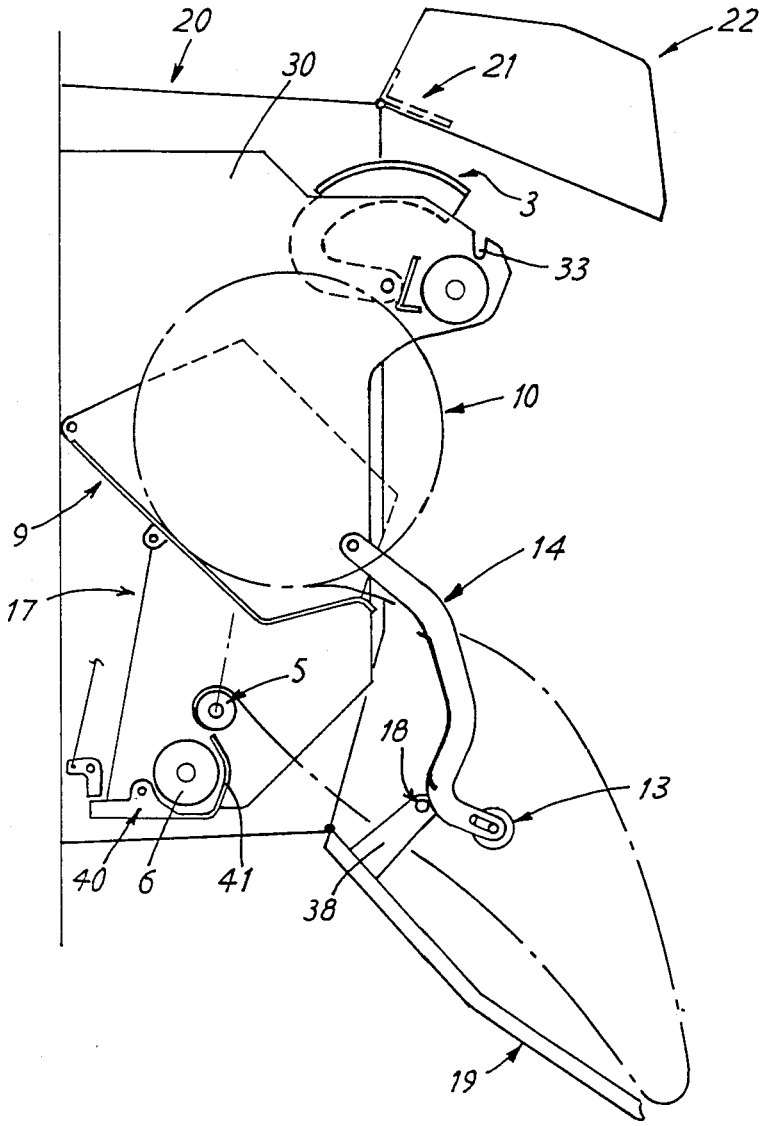

Referring now to side B, when link 15A is in its "down" position, as shown in FIGS. 4 and 5, lever 35B contacts a pivotal plate 40B. Plate 40B has a flange 41B which holds take-up roller 5B out of contact with its driving roller 6B. Plate 40B is biassed by a spring (not shown) in a clockwise direction. When link 15A is moved upwardly, lever 35B is pivoted away from plate 40B which then pivots under the effect of the spring to allow take-up roller 5B to drop into operative contact with its driving roller 6B. Pivoting of the plate 40B also operates a further link 16B connected to a latch 46B which releases the pivoting shield 3B containing reserve towel on side B. Shield 3 is biassed (by means not shown) upwards and rearwards into the cabinet to the position shown in FIG. 2, thus releasing the reserve towel on side B.

Operation of this towel continues to drive rollers 6A and 6B, winding the towel onto take up roller 5B and also winding up the exposed 'tail' end of the towel at side A onto take up roller 5A, thus removing this towel from view. The absence of shield 3A now gives an indication that the towel at side A needs to be replaced by laundered towel. The towel at side B remains in operation.

The towel at side A may be changed at any time during operation of the towel at side B.

The removal of a soiled towel will now be described with particular reference to FIG. 4. Soiled towel is removed by opening a cabinet bottom door 19. The soiled towel 12 together with its take up roller 5 can then be removed from the front of the cabinet. The take up roller is removed from the soiled towel and repositioned in its guide slots. It should be noted that the soiled towel can only be removed with arms 14 in their "up" position, FIG. 5.

The pinch roller 13 is then lifted up from its retention slots 33 and pivoted forwards and downwards on its two arms 14. The clean towel reservoir 9 is then also pivoted downwards to accept a clean towel roll. This action operates a further linkage 17 acting on the same side which re-sets the pivoting plate 40 which holds the take up roller 5 away from the roller 6. This action also causes linkage 16 to reset to enable shield 3 ultimately to be locked into its closed position. A length of clean towel is pulled from the roll and threaded under the guide bar 18 and then wound round the take up roller 5 in the correct direction for rewinding. The pinch roller 13 is then pivoted upwards and repositioned in its retention slot 33 thus forming the towel loop, see FIG. 5. The cabinet bottom door 19 is now closed. Finally the towel loop is rolled or folded upwards into the space directly between the upper rollers and the top edge of the bottom door, the pivoting shield 3 is moved into place beneath the gathered towel loop latching into the catch 46 operated by linkage 16, and the top door 22 is shut, covering the reserve towel, see FIG. 5.

This leaves the towel cabinet locked, with towel in side B in operation and the towel in side A loaded in a state prepared for use, but completely covered to prevent use before towel in side B is exhausted.

Figure 2:
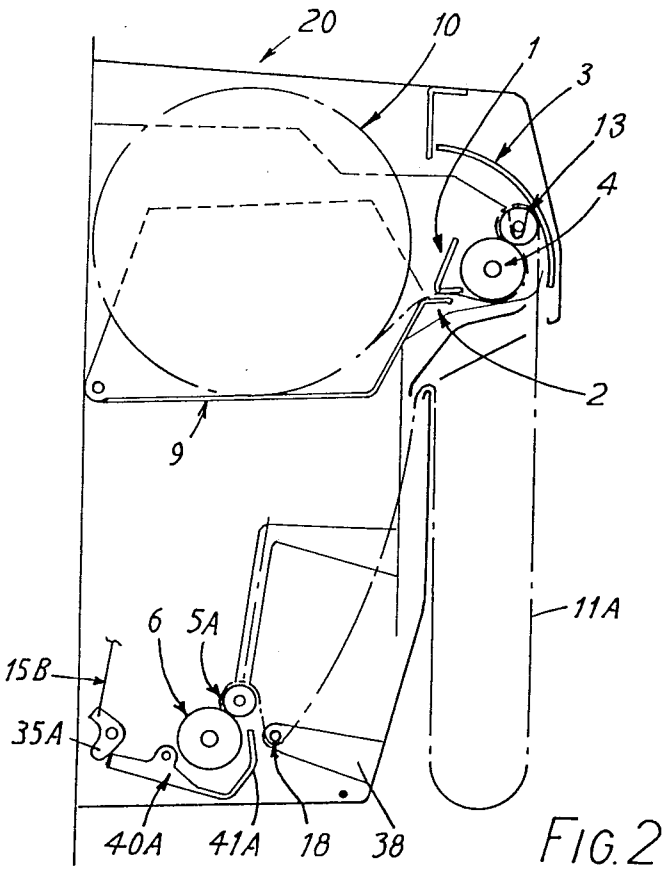

A safeguard against the reserve towel being loaded without being completely covered (in which case it would be possible to pull towel out of the cabinet without a corresponding amount being wound back in) is provided by a plate 21 attached to the top door 22 of the cabinet and positioned such that, if the pivoting shield 3 is not moved from its free position as shown in FIG. 4, then on attempting to close the door 22, plate 21 contacts shield 3 preventing the door from closing. Before door 22 is opened the shield 3 engages the right hand face of plate 21 as shown in FIG. 2.

The towel at side B now operates as the towel at side A did during the first cycle. Thus on exhaustion of the towel at side B, the towel at side A is released for operation, and this operation fully rewinds the towel at side B into the cabinet.

In this way a continuous supply of towel may be achieved (assuming towel is serviced within the total capacity of 100 meters) and the soiled towel end is automatically withdrawn into the machine.

The diameter of the rollers and gearing relative to the escapement is such that a portion length of at least 22 cm of towel is dispensed, giving a minimum capacity of 450 hand drying operations if the cabinet is not serviced.

In order that the cabinet width may be kept to a minimum, it is envisaged that the width of the towel used may be approximately eight inches (20 cm). It is also intended that the cabinet shell will be configured such that either side may be converted to give a warm air drying facility. The towel mechanism is also capable of operating using a plastic reinforced paper 'scrim' disposable towel. Therefore the cabinet as a whole can be supplied as a completely flexible hand/face drying system capable of drying by means of any combinations of linen towel, paper scrim towel or warm air.

The above-described description has the advantage of providing a continuous supply of towel with the entire length of every towel being used. The reserve towel is only released for use on exhaustion of the first towel, and before being released it is completely concealed by its pivoting shield. It also has the advantage of a neat appearance since the action of advancing the replacement towel automatically winds in the exposed end of the used towel. The used towel can be replaced by a fresh towel at any time during use of the operational towel irrespective of which side is operational. By using a narrow towel the cabinet dimensions are kept to a minimum.

Various modifications may be made to the above described dispenser. For example, the reservoir 9 may be arranged to move so that the growing soiled towel roll 12 will partially occupy space made available by the diminishing size of clean towel roll 10. In this case, reservoir 9 is of such a shape and size as to prevent contamination of clean towel areas by soiled towel areas.

Towel metering device 7 may be a conventional time controlled arrangement. Alternatively a simple ratchet and pawl may be used to prevent the towels being pulled in the reverse direction.

As shown, cabinet doors 19 and 22 open and close independently. However the doors on each side, e.g. 19A and 22A, may be linked so that they open and close together.

It will be understood that the above description of the present invention is susceptible to various modifications, changes and adaptations.

What is claimed is:

1. A roller towel dispenser arrangement comprising first and second means for mounting respective roller towels, first detecting means for detecting when a roller towel mounted in said first mounting means is exhausted, first control means responsive to said first detecting means for allowing dispensing of a roller towel mounted in said second mounting means, second detecting means for detecting when said second roller towel is exhausted, and second control means responsive to said second detecting means for allowing dispensing of a roller towel mounted in said first mounting means.

2. An arrangement as claimed in claim 1, wherein each roller towel has a respective drive mechanism, each said drive mechanism including a driven roller and a take-up roller through which the respective towel is arranged to pass, the respective control means keeping said rollers apart when said towel is not in use and causing said rollers to move together to allow dispensing of said towel.

3. An arrangement as claimed in claim 1, wherein each said mounting means comprises a towel holding and concealing element, said element being actuated by the respective control means to automatically release the respective towel for use.

4. An arrangement as claimed in claim 3, wherein each said mounting means has at least one access door in the cabinet, said door having a plate projecting internally therefrom, said plate having a side face, and wherein said towel holding and concealing element has three positions, in the first of which it holds and conceals a respective towel, in the second of which (with said door closed) it releases a respective towel for use and engages said side face of said plate, and in the third of which (with said door open) it is in the path of said plate, whereby said door cannot be closed until said element is moved out of its third position.

5. An arrangement as claimed in claim 1, wherein each said mounting means comprises a pivotally-mounted reservoir and each said detecting means comprises a link member, and wherein, upon exhaustion of a respective towel contained in a said reservoir, said reservoir pivots to actuate said respective link member.

6. An arrangement as claimed in claim 5, wherein each said control means comprises a respective pivotal member, actuated by its respective link member, and pivoting of said pivotal member actuates respective towel feed means.

7. An arrangement as claimed in claim 6, wherein each said control means comprises a further respective link member connected to a towel holding and concealing element, and wherein said pivoting of said pivotal member also actuates said respective further link member thereby actuating said towel holding and concealing element.

8. An arrangement as claimed in claim 1, wherein each said mounting means includes a respective re-setting link member, whereby, upon a downward pivotal movement of said mounting means during insertion of a replacement towel, said re-setting link member re-sets said respective control means.

9. An arrangement as claimed in claim 8, and further comprising towel feed means actuable to an operative position and a non-operative position, wherein said respective re-setting link member actuates the respective towel feed means to its non-operative position.

10. A roller towel dispenser arrangement comprising first and second mounting means for mounting first and second roller towels to be dispensed respectively therefrom, first and second wind-up means for respectively winding up said first and second towels after use, detecting means for detecting when said first roller towel on said first mounting means is exhausted, and an element for holding and concealing said second roller towel on said second mounting means, wherein said element for holding and concealing said second roller towel is actuable by said detecting means whereby said element is automatically released to reveal said second towel on the second mounting means.

* * * * *